US006044996A

United States Patent [19]

Carew et al.

[11] Patent Number: 6,044,996

[45] Date of Patent: Apr. 4, 2000

[54] HOT FILL CONTAINER

[75] Inventors: David Lee Carew, St. Albans; Peter Robert McKinlay, Doncaster, both of Australia

[73] Assignee: Amcor Limited, South Melbourne, Australia

[21] Appl. No.: 09/051,673

[22] PCT Filed: Oct. 11, 1996

[86] PCT No.: PCT/AU96/00641

§ 371 Date: Jun. 29, 1998

§ 102(e) Date: Jun. 29, 1998

[87] PCT Pub. No.: WO97/14617

PCT Pub. Date: Apr. 24, 1997

[30] Foreign Application Priority Data

Oct. 19, 1995 [AU] Australia ..... PN6055

[51] Int. Cl.[7] ..... B65D 1/02; B65D 1/42; B65D 23/08

[52] U.S. Cl. ..... 215/381; 215/382; 220/609; 220/675

[58] Field of Search ..... 215/381–384; 220/675, 669, 609, 671

[56] References Cited

U.S. PATENT DOCUMENTS

| | | | |
|---|---|---|---|
| 4,497,855 | 2/1985 | Agrawal et al. | 428/35 |
| 4,805,788 | 2/1989 | Akiho | 215/381 |
| 4,863,046 | 9/1989 | Colette et al. | 215/381 |
| 5,178,289 | 1/1993 | Krishnakumar et al. | 215/1 C |
| 5,178,290 | 1/1993 | Ota et al. | 215/1 C |
| 5,222,615 | 6/1993 | Ota et al. | 215/1 C |
| 5,279,433 | 1/1994 | Krishnakumar et al. | 215/1 C |
| 5,303,834 | 4/1994 | Krishnakumar et al. | 215/381 |
| 5,337,909 | 8/1994 | Vailliencourt | 215/381 |
| 5,341,946 | 8/1994 | Vailliencourt et al. | 215/1 C |
| 5,407,086 | 4/1995 | Ota et al. | 215/383 |
| 5,704,503 | 1/1998 | Krishnakumar et al. | 220/675 X |

*Primary Examiner*—Sue A. Weaver
*Attorney, Agent, or Firm*—Workman, Nydegger & Seeley

[57] ABSTRACT

A hot fill container formed from a polymeric material is disclosed. The container comprises a base (4), a body (2), and a neck (1), wherein the body (2) comprises an odd number of spaced-apart panels (5) that are responsive to internal pressure changes in the container. Hot fill bottles of a given capacity having an uneven number of deformable panels, e.g., five of a given wall thickness, unexpectedly accommodate significantly higher volume reductions before collapsing and distorting in an uncontrolled manner than known hot fill bottles of the same capacity having an even number of panels, e.g., six of the same wall thickness.

15 Claims, 3 Drawing Sheets

HOT FILL CONTAINER

BACKGROUND OF THE INVENTION

1. Field of the Invention

The present invention relates to plastic containers which are suitable for receiving a hot fill product.

The term "container" is understood herein to mean any type of container, including, but not limited to, bottles and jars.

The present invention relates particularly, although by no means exclusively, to hot fill bottles formed from blow-moulded polyester resin.

2. Present State of the Art

Hot fill bottles are well known in the liquid packaging industry. In general terms, hot fill bottles are bottles that are filled with a liquid product that is hot, typically at least 80° C., and thereafter are sealed while the liquid is hot in order to provide adequate sterilisation.

Commonly, hot fill bottles are blow moulded from polyester resin and other suitable polymeric materials and comprise a base, a generally cylindrical body, a shoulder, and a neck.

Hot fill bottles manufactured from blow moulded polyester resin do not expand significantly on contact with hot liquid. However, as hot liquid cools, usually it contracts and thereby creates a partial vacuum in the sealed bottles. The partial vacuum generates inward forces on the walls of the bottles. Unless the inward forces are resisted by the structure of the bottles or the shape of the bottles change in a controlled manner in response to the inward forces, there is uncontrolled distortion of the walls of the bottles.

In many situations, uncontrolled distortion of hot fill bottles results in the bottles having a mis-shapen/buckled appearance which consumers assume is an indication that the bottles are damaged, and thereby detracts from the marketability of the bottles.

In order to avoid uncontrolled distortion of the walls of hot fill bottles, a known type of hot fill bottle comprises an even number of circumferentially spaced concave panels arranged in diametrically opposed pairs in the cylindrical body of the bottle. The concave panels do not resist the internal pressure changes as hot liquid cools in the bottle but respond to the changes by flexing or deforming inwardly as hot liquid in the sealed bottles contracts as it cools in the bottles.

Whilst this known type of hot fill bottle is able to accommodate typical volume reductions in current hot-fill applications, the concave panels form a significant part of the body of the bottle and provide inadequate support for a label to be wrapped around the bottle. In marketing terms, this is a significant disadvantage of the bottle.

As a consequence, a known modified hot fill bottle comprises concave panels having central raised label support sections which define contact areas for labels.

The use of the label support sections addresses the need to provide sufficient contact area for labels. However, a disadvantage is that the label support sections are relatively rigid and reduce the volume that can be accommodated by the panels—with the effect on volume reduction being directly related to the relative surface areas of the label support sections and the concave sections of the panels.

It has been found that the maximum volume reduction that can be accommodated by commercially available hot fill bottles having label support sections is close to the typical volume reduction of liquids that occurs in current hot-fill applications when the liquids cool from hot fill temperatures (at least 80° C.) to ambient temperature. As a consequence, in practice, it has been found that the panels of a significant percentage of the commercially available hot fill bottles are not able to move inwardly sufficiently to accommodate the reductions in volume and, consequently, these bottles collapse and distort in an uncontrolled manner.

One possible solution to this problem is to increase the wall thickness of the hot fill bottles. However, this solution carries with it a relatively high economic cost due to additional raw materials and handling costs.

OBJECTS AND BRIEF SUMMARY OF THE INVENTION

An object of the present invention is to provide a hot fill bottle which avoids the problem of uncontrolled distortion of the walls of the bottle.

According to the present invention there is provided a hot fill container formed from a polymeric material, which container comprises, a base, a body, and a neck, wherein the body comprises an odd number of spaced-apart panels that are responsive to internal pressure changes in the container.

It is preferred that the panels be responsive to internal pressure changes within the container that occur when, in use, the container is filled with a hot liquid at a temperature of at least 80° C., more preferably at least 85° C., sealed, and the liquid cools to ambient temperatures thus reducing the volume defined by the container.

The present invention is based on the unexpected finding of the applicant that hot fill bottles of a given capacity having an uneven number of deformable panels of a given wall thickness can accommodate significantly higher volume reductions before collapsing and distorting in an uncontrolled manner than known hot fill bottles of the same capacity having an even number of panels of the same wall thickness.

In the case of 500 mL capacity bottles filled with liquid at a temperature of at least 80° C., preferably at least 85° C., it is preferred that the panels be adapted to accommodate volume reductions of at least 25 mL as the hot-filled container cools to ambient temperatures.

In the case of 750 mL capacity bottles filled with liquid at a temperature of at least 80° C., preferably at least 85° C., it is preferred that the panels be adapted to accommodate volume reductions of at least 36 mL as the hot-filled container cools to ambient temperatures.

In the case of 1 litre capacity bottles filled with liquid at a temperature of at least 80° C., preferably 85° C., it is preferred that the panels be adapted to accommodate volume reductions of at least 45ml as the hot-filled container cools to ambient temperatures.

It is preferred that the container be blow moulded.

It is preferred that the body be generally cylindrical.

With such an arrangement it is preferred that the panels be spaced apart around the circumference of the body.

It is preferred particularly that there be a uniform spacing between the panels.

In one embodiment, it is preferred that the body comprises 5 panels.

It is preferred particularly that the body comprises 5 panels when the capacity of the container is less than 1 litre.

In another preferred embodiment it is preferred that the body comprises 7 panels.

It is preferred particularly that the body comprises 7 panels when the capacity of the container is equal to or greater than 1 litre.

The panels may be of any suitable configuration which is adapted to be responsive to changes in internal pressure in the container.

In one embodiment, it is preferred that the panels comprise panel walls that are adapted to flex or deform inwardly.

With such an arrangement, it is preferred that the panel walls be concave.

In another embodiment, it is preferred that the panels comprise label support sections that are relatively rigid and hinge assemblies that interconnect the label support sections and adjacent sections of the body and allow the label support sections to move inwardly.

It is preferred that the panels be axially elongated.

It is preferred that the body further comprises a plurality of vertical lands that separate the panels.

It is preferred that the body further comprises horizontal lands above and/or below the panels.

It is preferred that the body further comprises circumferential and/or axial reinforcing ribs.

It is preferred that the container further comprises a neck-to-body transition.

It is preferred that the neck-to-body transition be a shoulder.

It is preferred particularly that the shoulder be frusto-conical.

It is preferred more particularly that the frusto-conical shoulder comprises a plurality of spaced apart panels.

It is preferred that the neck be threaded to receive a cap.

The polymeric material may be any suitable material such as polyester and polypropylene.

BRIEF DESCRIPTION OF THE DRAWINGS

The present invention is described further by way of example with reference to the accompanying drawings in which.

DETAILED DESCRIPTION OF THE PREFERRED EMBODIMENTS

Figure 1:
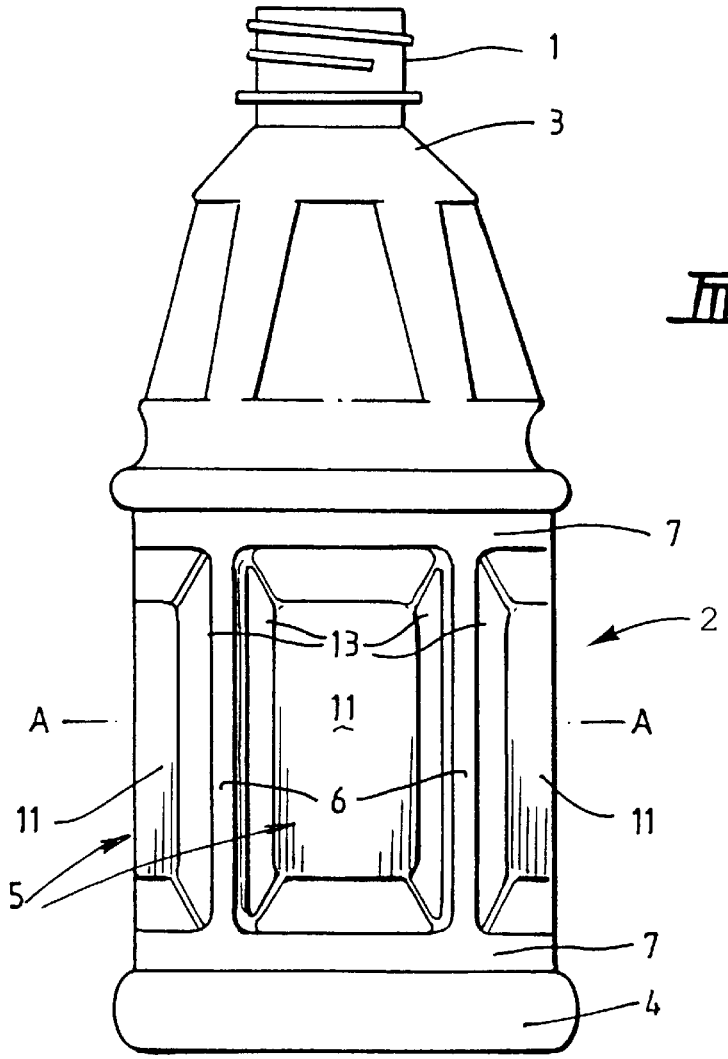
FIG. 1 is a side elevation of one preferred embodiment of a bottle in accordance with the present invention.
Figure 2:
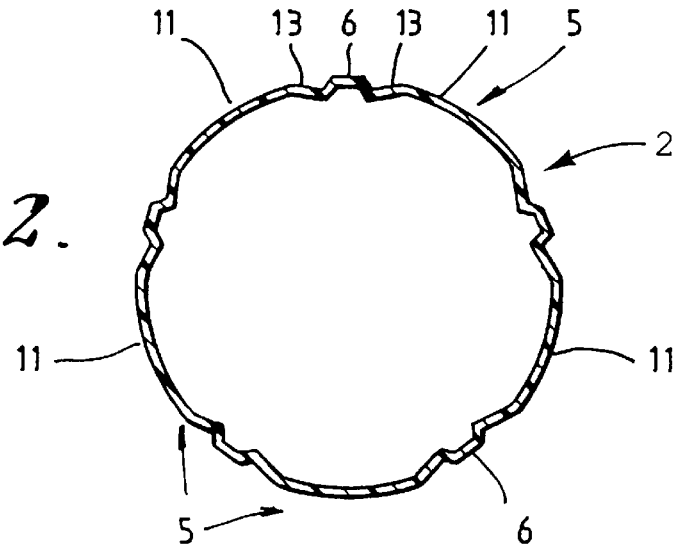
FIG. 2 is an enlarged cross-section along the line A—A of FIG. 1.

The bottle shown in FIGS. 1 and 2 is adapted to be hot-filled with liquid and comprises:

i. a neck 1;

ii. a generally cylindrical body 2;

iii. a neck-to-body transition 3 in the form of a generally frusto-conical shaped shoulder; and iv. a base 4.

The main feature of the bottle is that the body 2 comprises five panels, generally identified by the numeral 5, which are responsive to changes in internal pressure in the bottle that occur when a liquid is hot filled into the bottle at a temperature of at least 80° C. and, after the bottle is sealed, cools to ambient temperature to prevent uncontrolled distortion of the bottle.

The body 2 comprises vertical lands 6 that separate the panels 5 and horizontal lands 7 that are above and below the panels 5. It is noted that in the present instance the term "lands" is used in a general sense and covers structures that are also referred to as "posts".

The panels 5 are generally elongate and are spaced uniformly around the circumference of the body 2. Each panel 5 comprises:

i. a central section 11 that is curved in transverse section—as shown in FIG. 2—and defines a label support; and ii. an outer section 13 that encloses the central section 11 and interconnects the central section 11 and the vertical and horizontal lands 6, 7.

The outer section 13 of each panel 5 acts as a hinge and enables the central section 11 to move inwardly as hot filled liquid in the bottle contracts as it cools to ambient temperatures.

The bottle may be formed by blow moulding a polyester resin, such as polyethylene terephthalate.

In order to investigate the performance of the present invention the applicant carried out computer modelling on the bottle shown in FIGS. 1 and 2 and on a selection of commercially available 6-panel hot fill bottles. The purpose of the computer modelling was to predict the reduction in volume that the bottles could accommodate before collapsing into an unacceptable shape.

Figure 3:
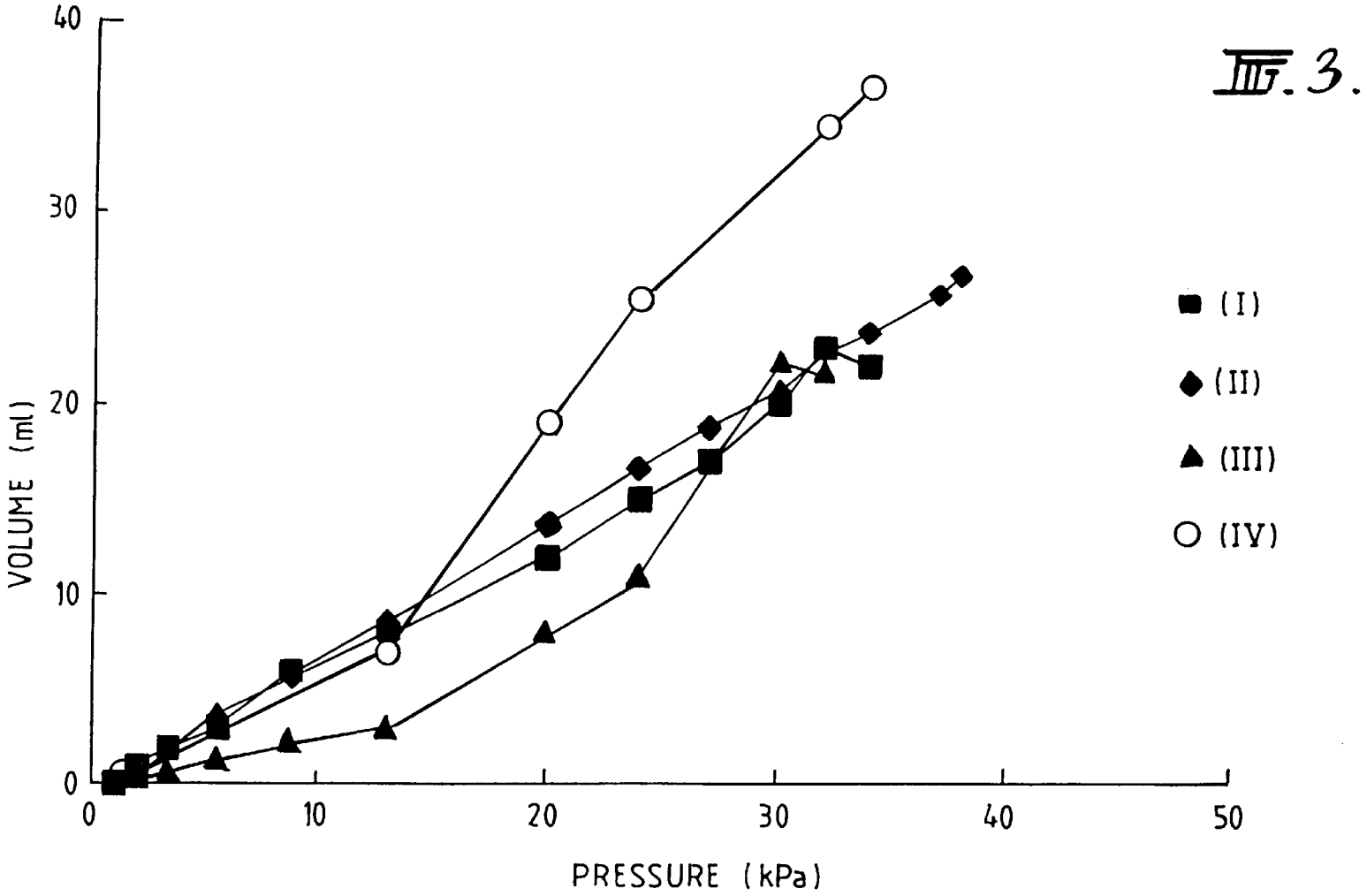
FIG. 3 is a graph which illustrates the predicted performance the bottle shown in FIG. 1 and a known 6-panel bottles.

The results of the computer modelling are shown in FIG. 3.

With reference to FIG. 3 the various plots illustrate the reduction in volume of each of four 750 ml sealed bottles as pressure is applied to the outside of the bottles.

The plots identified by the numerals i, ii and iii in the legend of FIG. 3 illustrate the predicted performance of three known 6-panel hot fill bottles and the plot identified by the numeral iv in the legend of FIG. 3 illustrates the predicted performance of the preferred embodiment of the present invention.

The graph shows that the three known 6-panel bottles collapsed at volume reductions of the order of 22 to 26 ml. This volume reduction is close to the typical volume reduction of a 750 ml volume of a wide range of liquids that are routinely hot filled into bottles at a temperature of 80° C.

The graph also shows that the preferred embodiment of the bottle of the present invention shown in FIGS. 1 and 2 collapsed at a significantly higher volume reduction of the order of 36 mls. This bottle could accommodate the typical reduction in volume of the wide range of liquids that are routinely hot filled into bottles at a temperature of 80° C.

Figure 4:
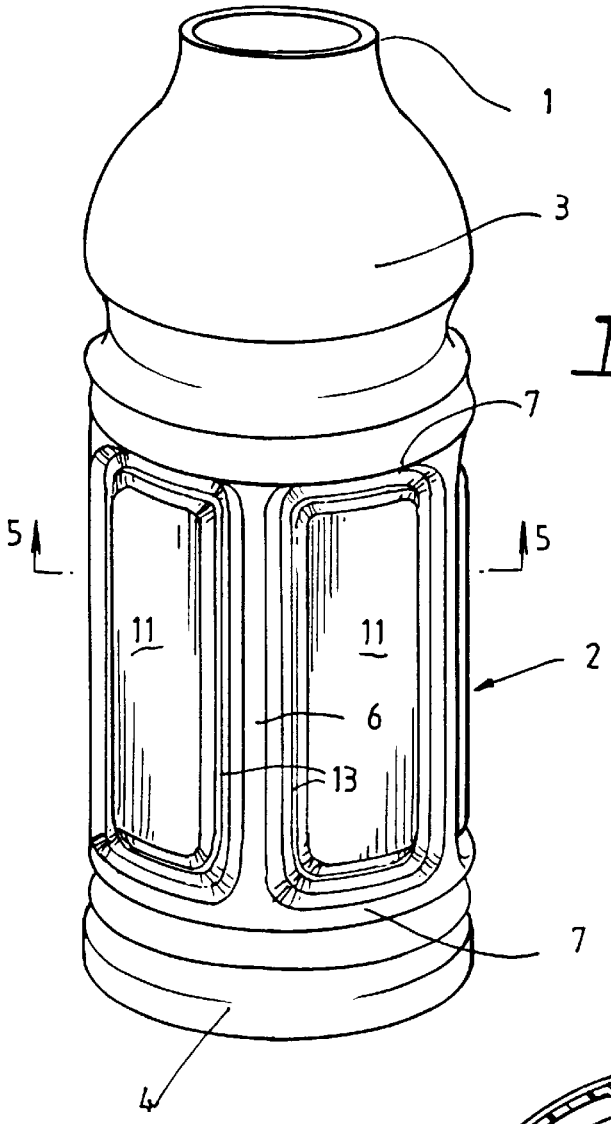
FIG. 4 is a perspective view of another preferred embodiment of a bottle in accordance with the present invention.
Figure 5:
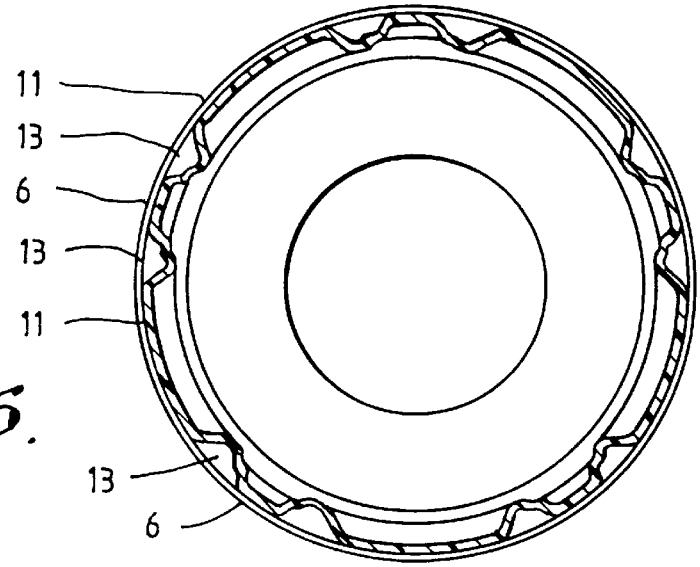
FIG. 5 is a section along the line 5—5of FIG. 4.

The bottle shown in FIGS. 4 and 5 is conceptually the same as the bottle shown in FIGS. 1 and 2 and the same reference numerals are used to denote the same parts.

The bottle has a different overall shape to that of the bottle shown in FIGS. 1 and 2.

The main structural difference is that the bottle has a different form of hinge that interconnects each panel 5 to the vertical and horizontal lands 6, 7 of the body 2 to that shown in FIGS. 1 and 2. As can best be seen in FIG. 5, the hinge is in the form of a double-S.

The performance of the bottle shown in FIGS. 4 and 5 was evaluated against that of a commercially available 6-panel hot-fill bottle.

A number of sample bottles shown in FIGS. 4 and 5 were blown, and the sample bottles and conventional 6-panel bottles were subjected to testing according to a standard testing procedure. The results are set out in the following table.

| Evaluation | 5 Panel Bottle Trial | 6 Panel Bottle | Standard |
|---|---|---|---|
| Weight (g) | 35.5 | 35.3 | |
| Bottle dimensions (mm) | | | Nominal |
| Overall Height | 191.91 | 194.2 | 189.76 |
| Major Diameter | 69.22 | 69.9 | 71.0 |
| Pinch Diameter | 59.12 | 59.3 | 59.0 |
| Panel Diameter | 67.71 | 67.6 | 69.0 |
| Capacity at Fill Point (20 mm down from top) (mL) | 520 | 523 | Minimum 511 |
| Brimful Capacity (mL) | 534 | 537 | Minimum 526 |
| Finish Dimensions (mm) | | | |
| "T" Diameter | 37.2 | 37.2 | — |
| "E" Diameter | 34.9 | 34.9 | — |
| Bore | 29.8 | 29.8 | — |
| Vacuum Load (in Hg) | 10.4 | 4.7 | Minimum 6.5 |
| Section Weights (g)** | | | |
| Base | 6.9 | 7.1 | — |
| Label Panel | 11.2 | 10.6 | — |
| Belt | 2.3 | 2.1 | — |
| Top | 15.0 | 15.3 | — |
| Thermal Stability Test | | | |
| a. Shall not burst | OK | OK | — |
| b. Shall not develop rocker bottoms | OK | OK | — |
| c. Shall not develop objectionable appearance | OK | OK | — |
| d. Volume change (%) | | | |
| Nett Shrinkage | 1.9 | 2.8 | maximum |
| Base Distortion | 1.0 | 0.9 | — |
| True Shrinkage | 2.9 | 3.7 | — |
| e. Overall height change (%) | 0.6 | 0.9 | 1 |
| f. Body diameter change (%) | 0.3 | 2.2 | 1 |
| g. Panel diameter change (%) | 2.7 | 2.8 | 0.8 |

**Sections defined by cuts at 17 mm, 109 mm an 129 mm from bottle of the bottle.

With reference to the table, the heading "Vacuum Load" indicates that significantly higher internal pressure, 10.4 Hg vs 4.7 Hg, was required to collapse the hot fill bottle shown in FIGS. 4 and 5. These figures are a clear indication that the hot-fill bottle shown in FIGS. 4 and 5 had significantly better stability under hot fill conditions than the conventional 6-panel bottle.

Many modifications may be made to the preferred embodiment described above without departing from the spirit and scope of the present invention.

For example, whilst the label support sections 11 of the bottles shown in FIGS. 1/2 and 4/5 represent a relatively large proportion of the surface area of the panels 5, it can readily be appreciated that the present invention is not limited to such an arrangement and the area of the label support sections may be selected as required.

We claim:

1. A hot fill container comprising a base, a body, and a neck, the body having a substantially circular transverse cross section and including a plurality of spaced-apart vertical lands and an odd number of spaced-apart panels, each panel being disposed between corresponding vertical lands and including an outwardly curved central section and outer sections, the outer sections connecting with the corresponding vertical lands, and the panels are responsive to internal pressure changes in the container, the container being comprised of polymeric material.

2. The container defined in claim 1, wherein the panels are responsive to internal pressure changes within the container that occur when, in use, the container is filled with a hot liquid at a temperature of at least 80° C. sealed, and the liquid cools to ambient temperatures thus reducing the volume defined by the container.

3. The container defined in claim 1, wherein the body is generally cylindrical.

4. The container defined in claim 1, wherein the panels are spaced apart around the circumference of the body.

5. The container defined in claim 4, wherein there is a uniform spacing between the panels.

6. The container defined in claim 5, wherein there are 5 panels.

7. The container defined in claim 6, wherein the capacity of the container is less than 1 litre.

8. The container defined in claim 1, wherein the capacity of the container is at least 1 litre.

9. The container defined in claim 1, wherein the panels comprise panel walls that are adapted to flex or deform inwardly.

10. The container defined in claim 1, wherein the panels comprise label support sections that are relatively rigid and hinge assemblies that interconnect the label support sections and adjacent sections of the body and allow the label support sections to move inwardly.

11. The container defined in claim 1, wherein the body further comprises horizontal lands above the panels.

12. The container defined in claim 1, wherein the body further comprises horizontal lands below the panels.

13. The container defined in claim 1, wherein the body further comprises circumferential reinforcing ribs.

14. The container defined in claim 1, further comprises a neck-to-body transition.

15. The container defined in claim 1, wherein the neck is threaded to receive a cap.

* * * * *